United States Patent [19]

Small et al.

[11] 4,349,185

[45] Sep. 14, 1982

[54] FOLDING APPARATUS

[75] Inventors: Rudolph E. Small; Michael H. Spalding, both of Green Bay, Wis.

[73] Assignee: Paper Converting Machine Company, Green Bay, Wis.

[21] Appl. No.: 170,700

[22] Filed: Jul. 21, 1980

[51] Int. Cl.[3] ..... B41L 43/00

[52] U.S. Cl. ..... 270/32; 270/42

[58] Field of Search ..... 270/32, 37–51, 270/54, 58, 59, 60; 493/444, 243, 244; 198/817; 493/210, 224

[56] References Cited

U.S. PATENT DOCUMENTS

| | | | |
|---|---|---|---|
| 950,014 | 2/1910 | Boyce | 270/49 |
| 1,845,895 | 2/1932 | Voorhis | 493/444 X |
| 2,016,309 | 10/1935 | Zuckerman | 270/48 X |
| 2,775,171 | 12/1956 | Steen | 493/243 X |
| 3,758,381 | 9/1973 | Knoke | 198/817 X |
| 4,279,410 | 7/1981 | Bolza-Schunemann | 270/50 X |

*Primary Examiner*—Edgar S. Burr
*Assistant Examiner*—A. Heinz
*Attorney, Agent, or Firm*—Tilton, Fallon, Lungmus & Chestnut

[57] ABSTRACT

Folding apparatus for quarter-folded web products such as paper napkins wherein belt means are associated with a pair of vacuum folding rolls for stripping products from one roll and thereafter urging the product against a simultaneously folded product carried by the other roll and thereafter delivering both products in superposed relation along a horizontal path.

7 Claims, 4 Drawing Figures

FOLDING APPARATUS

BACKGROUND AND SUMMARY OF INVENTION

This invention relates to folding apparatus and, more particularly, for apparatus useful in the production of a quarter-folded product such as a paper napkin.

Napkin folders have been available for a long time. The procedure employed over the years is straight-forward and well known, i.e., a web is longitudinally folded by passing through a plow or similar V-plate after which the two-ply web is transversely cut into discrete lengths. Thereafter, the web is passed through a series of rollers that sequentially cut the web into discrete segments. Normally, to get a square unfolded napkin, the cutoff distance is twice the width of the longitudinally folded web. Thereafter, through the use of a vacuum roll, an intermediate portion of the now discrete web segment is gripped and caused to fold on itself transversely—thereby developing a napkin one-quarter the area of the unfolded web.

This general arrangement is depicted in a number of subsequent, co-owned patents. For example, U.S. Pat. Nos. 3,256,012 and 3,740,049 have to do with packing devices that deliver individual folded napkins into delivery magazines after they have been processed as above. U.S. Pat. Nos. 3,689,061 and 3,870,292 also show the same general procedure outlined above but proceed further in teaching the means for introducing additional folds.

Also over the years, the art workers have learned that it is most efficient to operate with a two-wide parent roll so as to produce two napkins simultaneously. Use of two-wide parent rolls, slitting and simultaneously processing of the separated and continuous web halves was, and remains, a space efficient and highly productive arrangement that doubles producing by using a duplicate series of rollers to produce pairs of superposed napkins which are subsequently stripped from vertical delivery belts by a reciprocating or orbiting packer finger for delivery into a magazine for manual packing. Numerous machines with vertical delivery systems of this type are in production worldwide, but in more competitive markets and with escalating labor costs, the addition of automatic stacking and automatic delivery of pre-counted stacks becomes all important for cost effective productivity.

The optimum arrangement of a two-wide parent folder would be to have the slit webs travel vertically downward into folding rolls and then horizontally away so as to be orbitally packed—it being appreciated that where the napkins delivered vertically (as they have for many years), they must stand on end, a difficult achievement for relatively flimsy webs. To perform the entire sequence horizontally is and has been, unacceptable because of space requirements.

The attempts to provide the optimum arrangement have suffered from crucial defects. One approach was to place a folding roll on each side of the horizontal delivery path. This meant an extensive or long "draw" of one of the slit portions of the parent web and caused the operation to be unreliable at times besides occupying extra space and raising the possibility of improper registry of embossing patterns. The alternative would be to place the folding rolls side-by-side in horizontally aligned relation in the paths of the two slit webs from the parent roll to avoid unequal draws. But this posed a deterrent because to deliver the quarter-folded napkins along a horizontal path, the webs would have to be distorted while their direction of travel was changed.

According to the present invention, the optimum arrangement has been achieved through the use of special belt means which operate to strip the product from one folding roll and thereafter urge the product against a simultaneously produced product carried by the other roll and which also delivers both products in superposed relation along the advantageous horizontal path.

Other objects and details of the invention may be seen in the details of the ensuing specification.

DETAILED DESCRIPTION

The invention is described in conjunction with the accompanying drawing, in which.

Figure 3:
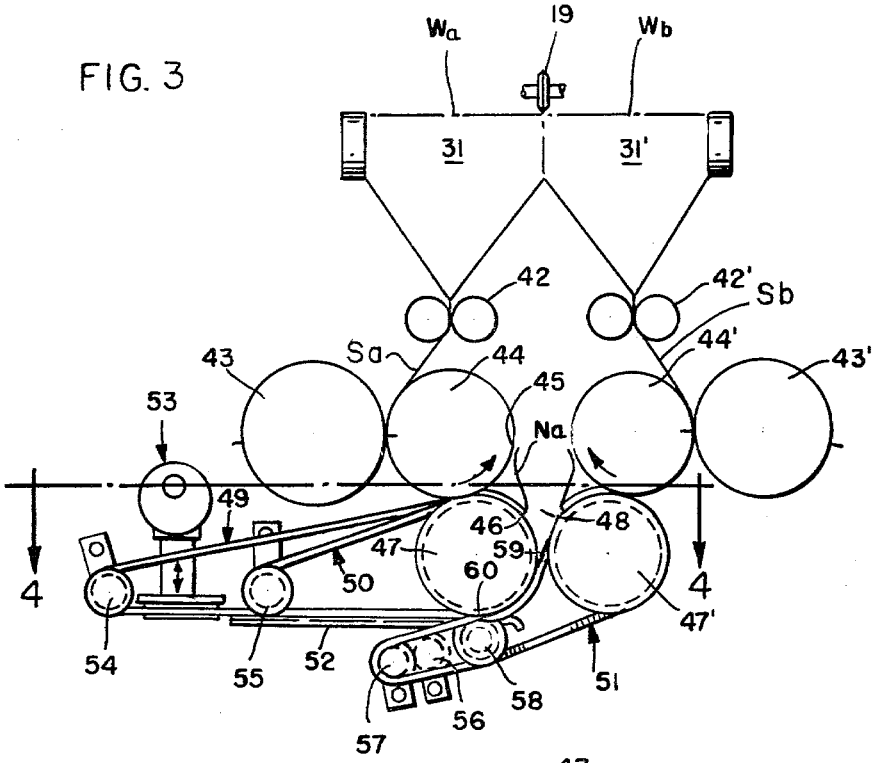
Figure 4:
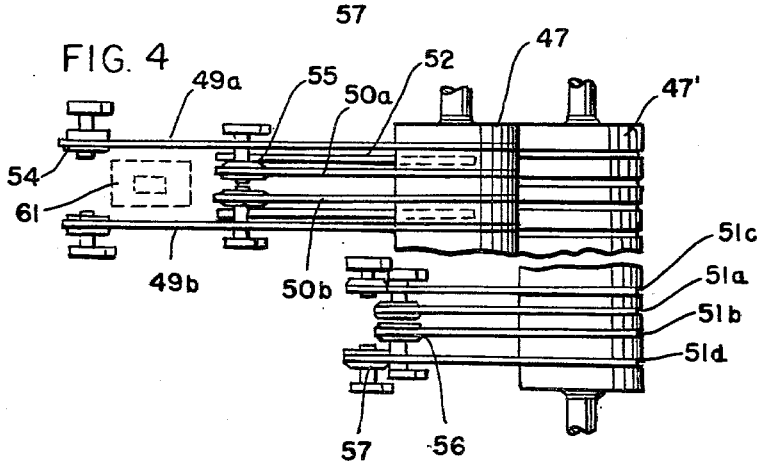

FIG. 3 is an end elevational view of the inventive napkin folder with folding rolls arranged substantially horizontal, including a plurality of transfer belts which deliver superposed folded napkins into a pack-out zone and an automatic stacking-delivery device for precounting and delivering packages of products; and FIG. 4 is a fragmentary plan view of the machine of FIG. 3 showing the arrangement of delivery belts therein.

Figure 1:
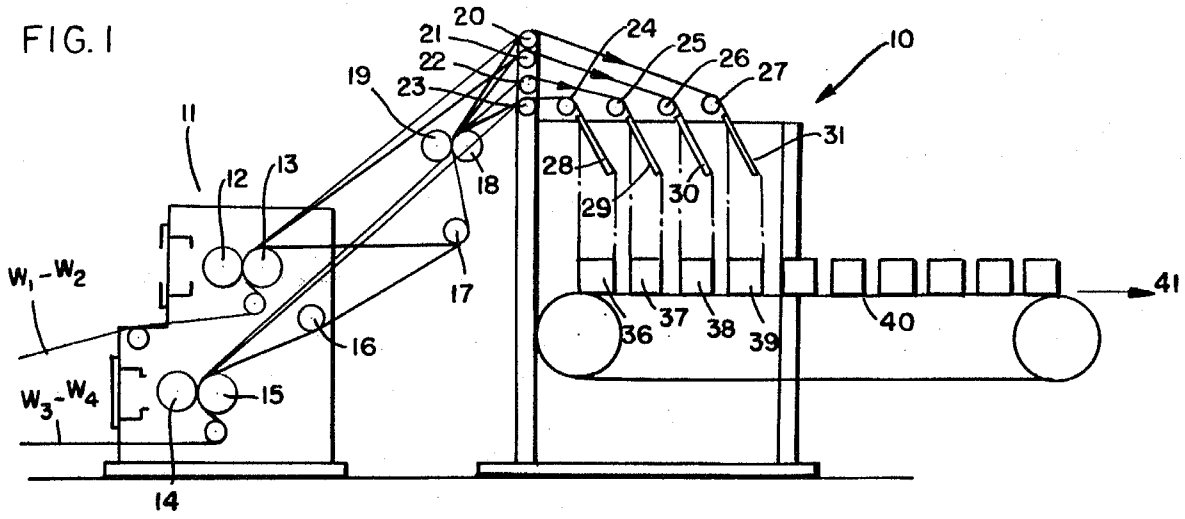
FIG. 1 is a side elevational view showing a multi-width machine wherein one half of each two-wide web is slit and delivered to one of a plurality of folding plates, and after folding, to one of a plurality of delivery lanes.

Referring first to FIG. 1, the inventive napkin machine arrangement is seen schematically in side elevation to describe the sequence of web travel from unwind through the napkin folding machine. In this instance, a total of four webs, $W_1$, $W_2$, $W_3$ and $W_4$, each travel from separate unwind stands (not shown) into an embosser 11. Two superposed webs $W_1$ and $W_2$ pass through the nip of engraved rolls 12 and 13 while webs $W_3$ and $W_4$ pass through the nip of engraved rolls 14 and 15. The web pairs are passed over guide rolls 16 and 17 and united to form superposed webs which then pass through the nip between an anvil roll 18 and a slitter 19.

Each of the webs $W_1$–$W_4$ is two-wide, i.e., being twice the width of the unfolded napkins, and after passing through the slitter, two adjacent slit webs such as $W_a$ and $W_b$ (see FIG. 3) are provided from each of the original webs $W_1$–$W_4$.

To separate the superposed slit webs, the webs are directed first over rollers 20–23 and then over guide rolls 24–27—see the upper central portion of FIG. 1. The now separated, slit webs are directed over folding plates 28–31, as seen in FIG. 1.

More particularly, because the web has been slit, each longitudinal half of the web passes over its own folding plate as at 31 and 31' in FIG. 3. For clarity of presentation, the various cutoff and folding rolls of FIG. 3 are not illustrated in FIG. 1.

Figure 2:
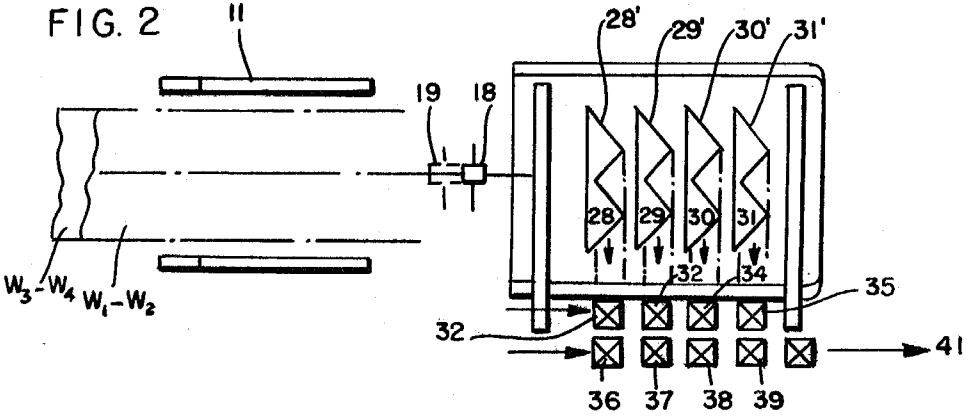
FIG. 2 is a plan view showing how each web is slit in two, with each half-web being routed over juxtaposed folding plates for subsequent folding and delivery in pairs into one delivery lane.

After transverse severance and folding, each pair of napkins are stacked in position 32–35 of FIG. 2, and subsequently, completed stacks of 50, 100, etc. napkins are pushed into buckets 36–39 of conveyor 40 for travel in the direction of arrow 41 for subsequent packaging.

Now turning to FIG. 3, the steps of the invention to convert the webs $W_a$ and $W_b$ into napkins will now be described. At the very top center, the slitter 19 is represented schematically and the slit webs $W_a$ and $W_b$ are drawn over the folding plates 31 and 31', respectively, by pair of draw rolls 42 and 42' to yield equal web runs $S_a$ and $S_b$ between the respective draw roll sets and coacting cutoff-anvil rolls.

For the web run $S_a$, the cutoff or knife roll is designated 43 and the cooperating anvil roll is designated 44. Correspondingly, the cutoff and anvil rolls for the web run $S_b$ are designated 43' and 44', respectively.

The cutoff rolls 43, 43' have protruding blades which operate in conventional fashion with axially extending slots in the surface of the anvil rolls 44, 44'. This results in severing the web runs $S_a$ and $S_b$ into discrete segments. At several points around the periphery of the anvil rolls 44, 44', there are provided axially extending lines of vacuum holes so as to control the leading edge of each discrete segment. Such holes would be positioned as at 45 relative to the partially formed napkin end $N_a$.

In like fashion, a similar series of vacuum holes as at 46 are provided in the folding rolls 47 and 47'. These operate to hold the generally central portion of the web segment or napkin to cause a transverse fold and result in a four panel napkin being formed, as illustrated in the central lower portion of FIG. 3.

As the rolls 47, 47', the partially completed napkin segment 10*a* are brought into a nip 48 formed by the relationship of the rolls 47, 47' and wherein the two napkins are beginning to be arranged in face-to-face or superposed relation.

Although stripping belt removal of web segments from vacuum rolls has long been used in the paper converting art, generally and particularly relative to quarter-folded napkins, the arrangement of the various belts according to the invention has not been employed.

Generally speaking, the napkins from the folding roll 47 are stripped by means of a longer belt system generally designated 49 and a shorter belt system generally designated 50 while the napkins from the folding roll 47' are stripped therefrom by means of a belt system generally designated 51. Cooperating with this belt system are a set of support bars 52 (mounted, like the other elements) on the frame of the machine, which support the superposed napkins during travel along a horizontal path on route to the orbital packing mechanism generally designated 53.

The plan arrangement of the various belt sets can be seen in FIG. 4. First, and relative to the folding roll 47, the numerals 49*a* and 49*b* designate some of the belts of the longer belt set and which are entrained within circular grooves in the folding roll 47. At their downstream ends, the belts 49*a* and 49*b* are reeved in pulleys 54.

The shorter belts 50*a* and 50*b* are likewise mounted in circumferential grooves in the roll 47 and, at their downstreams are reeved about pulleys 55. The shorter belts 50*a* and 50*b* of the belt system 50 are advantageous where napkins are not embossed overall but with a coin edge around the border, they can be used to advantage. In the open center version, after longitudinal folding, the caliper along the folded edge is different from the caliper of the superposed embossed webs and, as a result, this type of napkin is often skewed in the delivery belts. This is overcome by virtue of the shorter series of belts which gives an additional control in the center and overcomes the skewing tendency.

The belt system 51 has intermediate shorter belts at 51*a* and 51*b* with the outer belts being longer as at 51*c* and 51*d*—see the right hand portion of FIG. 4. The shorter belts 51*a* and 51*b* are entrained in circumferential grooves within the vacuum folding roll 47' and at their other ends are reeved in pulleys 56. The longer belts 51*c* and 51*d* in addition to being entrained within grooves in the folding roll 47' are reeved on pulleys 57. In FIG. 3, a grooved pulley or roll 58 is added to insure that the belt set 51 is in contact with the surface of roll 47.

In the operation of the apparatus just described, the new segment $N_a$ is "plucked" away from the anvil-carrier roll 44 by means of the vacuum folding roll 47—the same phenomenon occurring relative to the rolls 43' and 47'. After the web segments in partially transverse folded condition have been drawn into the nip 48, the belt systems 49 and 50 serve to strip the napkin from the roll 47 while the belt system 51 serves to strip the napkin from the folding roll 47'. However, the belt system 51 not only serves to strip napkins from the vacuum folding roll 47' but thereafter merges each individual napkin against a simultaneously produced napkin on the folding roll 47. Even further, these compressed napkins are then stripped from the belt system 51 by means of the stripper bar set 52 and are carried horizontally downstream by means of the belt systems 49 and 50, primarily outer belts 49*a* and 49*b*.

The introduction of the belt system 51 is responsible for a number of operational advantages. It not only strips the napkins serially from the folding roll 47' but also serves to combine each napkin with a fellow napkin from the companion folding roll 47. This insures precise positioning of the two napkins relative to each other for the difficult journey of traveling through an arcuate quadrant and thereafter into a straight path. Although vacuum holding power is available from the roll 47 during the travel through the quadrant defined by the points 59 and 60, this is substantially reduced relative to the napkin coming off the roll 47' because of the interposition of the napkin interposed between it and the surface of the roll 47. Reliance on such reduced vacuum folding power could result in unreliable operation and particularly serious machine jam-ups or short count stacks.

After the napkins have been united and conducted around the quadrant portion of the path between points 59 and 60 and wherein the belt system 51 is assisted by the addition of grooved roll 58, the superposed napkins are stripped from the spaced apart belts 51*a–d* by means of the bars 52 and thereafter conducted downstream in the horizontal path of delivery by means of the belt systems 49 and 50. The belt system or set 50 terminates short of the delivery zone and thus, in final effect, the napkin pair has been successfully joined, transported and delivered in such a manner that it can be contacted in a substantially large, central area 61 (shown in phantom in the left side of FIG. 4) for pack-out and delivery into the automatic stacking system. For this purpose, the orbital packer 53 is equipped with the usual orbiting fingers (not shown) to carry a partial stack of two napkins downwardly for deposit on a plate whereupon the completed stack is realized.

While in the foregoing specification a detailed description of an embodiment of the invention has been set down for the purpose of illustration, many variations in the details hereingiven amy be made by those skilled in the art without departing from the spirit and scope of the invention.

We claim:

1. Apparatus for producing stacked products such as paper napkins from a primary web comprising a frame, means on said frame for slitting said primary web into a pair of webs, advancing said pair of webs along side-by-side paths while longitudinally folding each web, and thereafter transversely severing each web to develop a first and a second series of discrete web products, a pair of folding rolls journalled in said frame, one for each of said series, vacuum means operably associated with said rolls for transversely folding each product, and endless belt means for stripping products from the roll of said first series and thereafter urging said product against a product carried by the roll of said second series for delivering both products in superposed relation along a horizontal path.

2. The apparatus of claim 1 in which said second series roll is equipped with second belt means separate from the first mentioned belt means for stripping product from said second series roll and advancing said superposed product along said horizontal path.

3. The apparatus of claim 2 in which said frame is equipped with bar means extending below said horizontal path for supporting superposed products, said second belt means urging said superposed products thereagainst while advancing the same.

4. The apparatus of claim 1 in which said advancing means includes two pairs of horizontally aligned and spaced apart draw rolls, each pair of draw rolls defining a nip for entry of web material therebetween said frame being equipped with a folding plate above each pair of draw rolls wherein said pair of webs is adapted to be derived from a common parent roll, the nip of said folding rolls being positioned below and between said pair of draw rolls.

5. The apparatus of claim 4 in which said means for transversely severing each web includes a cutoff roll and an anvil roll for each pair of draw rolls and positioned therebelow with each anvil roll forming a transfer nip with one of said folding rolls.

6. Apparatus for folding webs to develop stacked products such as paper napkins comprising a frame, a pair of folding plates mounted on said frame at horizontally spaced apart aligned relation and defining a pair of generally vertical paths for travel of indefinite length webs for longitudinally folding the same, cutoff and anvil roll means on said frame in each of said web paths for transversely severing the web in each path, first and second vacuum folding rolls on said frame in side-by-side relation arranged to receive cut web segments from said cutoff and anvil roll means arranged in each path including means to transversely fold the same, first and second endless belt means associated respectively with said first and second folding rolls for stripping said transversely folded segments from said folding rolls and superposing segments from one path with segments from the other path while said segments pass between said folding rolls, and subsequently delivering the superposed segments sequentially along a generally horizontal path.

7. The apparatus of claim 6 in which said first belt means includes a grooved roll for urging said first belt means against said second folding roll so as to press web segments stripped from said first folding roll against said second folding roll.

* * * * *